US006651778B1

(12) United States Patent
Manning et al.

(10) Patent No.: US 6,651,778 B1
(45) Date of Patent: Nov. 25, 2003

(54) SELF-SERVE LUBE SERVICE FOR TRUCKERS AND OTHER OVER-THE-ROAD VEHICLE OPERATORS

(75) Inventors: Kevin J. Manning, St. Charles, MO (US); Thomas P. Manning, Jr., St. Louis, MO (US)

(73) Assignee: Arogas, Inc., St. Charles, MO (US)

( * ) Notice: Subject to any disclaimer, the term of this patent is extended or adjusted under 35 U.S.C. 154(b) by 26 days.

(21) Appl. No.: 10/076,184

(22) Filed: Feb. 13, 2002

(51) Int. Cl.[7] ..... F16C 3/14; F16N 33/00
(52) U.S. Cl. ..... 184/1.5; 52/169.7
(58) Field of Search ..... 184/1.5; 52/169.7, 52/169.1, 174, 236.3

(56) References Cited

U.S. PATENT DOCUMENTS 3,603,046 A * 9/1971 Humphrey ..... 52/173.1
3,938,621 A * 2/1976 Bobbitt, Jr. ..... 184/1.5
5,613,331 A * 3/1997 LaGanke ..... 52/169.7
6,296,028 B1 * 10/2001 Oakland ..... 141/231
6,539,678 B1 * 4/2003 Campbell et al. ..... 52/169.7
2002/0139057 A1 * 10/2002 Ritzal ..... 52/79.1

* cited by examiner

*Primary Examiner*—David Fenstermacher
(74) *Attorney, Agent, or Firm*—Haverstock, Garrett & Roberts LLP

(57) ABSTRACT

A service center for the self-service lubrication of over-the-road vehicles, and the method of use thereof, which center has at least one service area into which the vehicle can be driven for servicing, one or more mobile lifting devices positionable by the vehicle operator to engage and lifts and to subsequently lower, a portion of the vehicle to be serviced under control of such operator, lubricant draining apparatus engageable with the vehicle by the operator and operable thereby to effect the drainage of lubricant from the vehicle, lubricant fill apparatus engageable with the vehicle and operable by the vehicle operator to feed fresh lubricant to the vehicle as required, including metering apparatus for determining the amount of lubricant fed to the vehicle, and an attendant system for controlling use of said service center and its equipment, including calculation of amounts due by the vehicle operator.

21 Claims, 6 Drawing Sheets

SELF-SERVE LUBE SERVICE FOR TRUCKERS AND OTHER OVER-THE-ROAD VEHICLE OPERATORS

The present invention is directed to a maintenance and lube service center, and method of use thereof, that enables the drivers or operators of vehicles, such as trucks, buses, and other over-the-road vehicles, to be able to self-service and lubricate their vehicles without requiring an on-site staff of service personnel to perform these services.

It is well recognized by the motoring public that, in order to maintain their vehicles in safe and roadworthy condition, it is advisable and desirable to periodically service and lubricate their vehicles, including to drain oil therefrom and to replace the drained oil with fresh lubricant. This is especially true of large over-the-road vehicles which are utilized for long and demanding transits on a repetitive basis, both by fleet operators and by individual owner/operators. The servicing of such vehicles may be accomplished by employing specific individuals to perform such tasks or by contracting with or utilizing third parties to service such vehicles. The costs associated with such servicing can, especially over a period of time, be substantial, and there may be difficulties in scheduling the servicing and in removing a vehicle from operation for a period of time. It may also be the case that the need for servicing arises at an inconvenient time or location where third party servicing is difficult, if not impossible, to obtain.

Consequently, many vehicles operators, especially individual owner/operators, attempt, on at least some occasions, to self-service their vehicles. Unless they can access a facility at which there are hydraulic or other lifts that they can use, or that have service pits or wells, that allow them access to the underside of their vehicles, the servicing of their vehicles can be a difficult and cumbersome project. Even if they can acquire access to a service facility that has a hydraulic lift and that allows self-service work on a vehicle, they must typically bring their own tools, they may have to acquire their own fresh oil, typically in cans or drums that they may have to transport to the service site, and they have to arrange for the disposal of waste oil and the newly emptied oil cans or drums.

Such servicing of large over-the-road vehicles at the operator's home is often proscribed or tightly regulated by local zoning ordinances, particularly in urban environments, and relatively few facilities exist that permit the self-servicing of vehicles on-site. Those facilities that do exist may require advance scheduling of the self-service area and, if hydraulic or other types of lifts are to be made available for use, may require that facilities' personnel be utilized to operate such equipment or that deposits or other compensation arrangements be made or be in place to cover any damages that might occur or any problems that may result. Additionally, such facilities may often not be generally available at the hours that may be most convenient to the vehicle operator.

In essence, to this point in time, the servicing of over-the-road vehicles has been problemsome. The present invention is intended to simplify and make the servicing of large over-the-road vehicles more convenient and less costly, including by enabling vehicle operators to easily effect the self-service lubrication of their vehicles at times convenient to them at facilities designed for such purpose.

With the present system, the driver or other vehicle operator is able to drive his vehicle into a building which serves as a service center and which is equipped with devices that enable the vehicle to be easily serviced and lubricated by him. The center will typically include mobile devices or apparatus positionable and operable by the vehicle operator to raise all or part of the vehicle to a desired elevation for easy access to the underside thereof for maintenance and to lubricate the vehicle such as by removing old lubricant and feeding new lubricant to the vehicle. The present invention includes the features of a novel building or facility into which such vehicles can be driven and which provides the equipment by which the operator of the vehicle, without the need for on-site service personnel, can perform all of the operations necessary to self-servicing of the vehicle, including upgrading the lubricant. By utilizing the present invention, the costs normally associated with servicing and lubricating over-the-road vehicles, particularly during transport, can be substantially reduced, and the availability of the equipment for changing the lubricant permits ready use and operation thereof by a vehicle operator without on-site service staff, thus further reducing the cost of maintaining vehicles, especially large vehicles such as trucks and buses.

The building or facility into which the vehicle is driven will typically include one or more service bays accessible through one or more openings or doorways through which a vehicle can be driven and will include mobile lifting devices and apparatus that will be positionable and operable by the vehicle driver or operator to enable the vehicle or a portion thereof to be raised to a desired height for ready access by him as he performs the servicing and lubricating. The building or facility will generally have storage reservoirs for holding and storing the lubricants that are used, draining apparatus for draining lubricants from the vehicle, and filling apparatus for refilling the vehicle with new lubricant, as required. The building or facility will typically also have provision for an attendant, such as a cashier or like person who will accept money or other forms of credit for the products and services rendered, or an automated attendant system, and may also include other spaces for the convenience of those who may be on the vehicle being serviced but whose actions are not required in the servicing process.

OBJECTS OF THE INVENTION

It is a principal object of the present invention to provide a novel service center, and the process of use thereof, for self-servicing and lubricating of vehicles such as trucks, buses and other over-the-road vehicles.

Another object is to reduce the costs normally associated with the servicing and lubrication of vehicles, especially large over-the-road vehicles.

A further object of the invention is to facilitate the servicing and lubricating of vehicles, in a convenient, easy-to-use way, and generally without the need for assistance from third parties.

Another object is to make it possible to service and lubricate vehicles at any time desirable to the vehicle operator, including during transit, and without the necessity for outside service personnel.

An additional object is to teach the construction and use of a building where relatively large vehicles can be serviced and lubricated, which building does not require service pits or wells for those doing the servicing and lubricating, and which is therefore less expensive to construct and to operate.

These and other objects and advantages of the present invention will become apparent after considering the following detailed specification which describes a preferred embodiment of the present invention.

DESCRIPTION OF THE INVENTION

The present invention makes it possible to conveniently and inexpensively self-service and lubricate vehicles, and especially large vehicles such as over-the-road trucks, buses, and the like. With the present invention it is possible for the driver or operator of such a vehicle to drive the vehicle into a service center equipped according to the present invention, and for the driver to thereafter service the vehicle, including the underparts thereof, and lubricate the vehicle, as needed, without any need of outside help. The provision of such a service center, and the method of use thereof, makes it possible for the person driving the vehicle to service and lubricate the vehicle at any time, convenient to him, including during cross-country transit, at the location where the service center is located.

Figure 1:
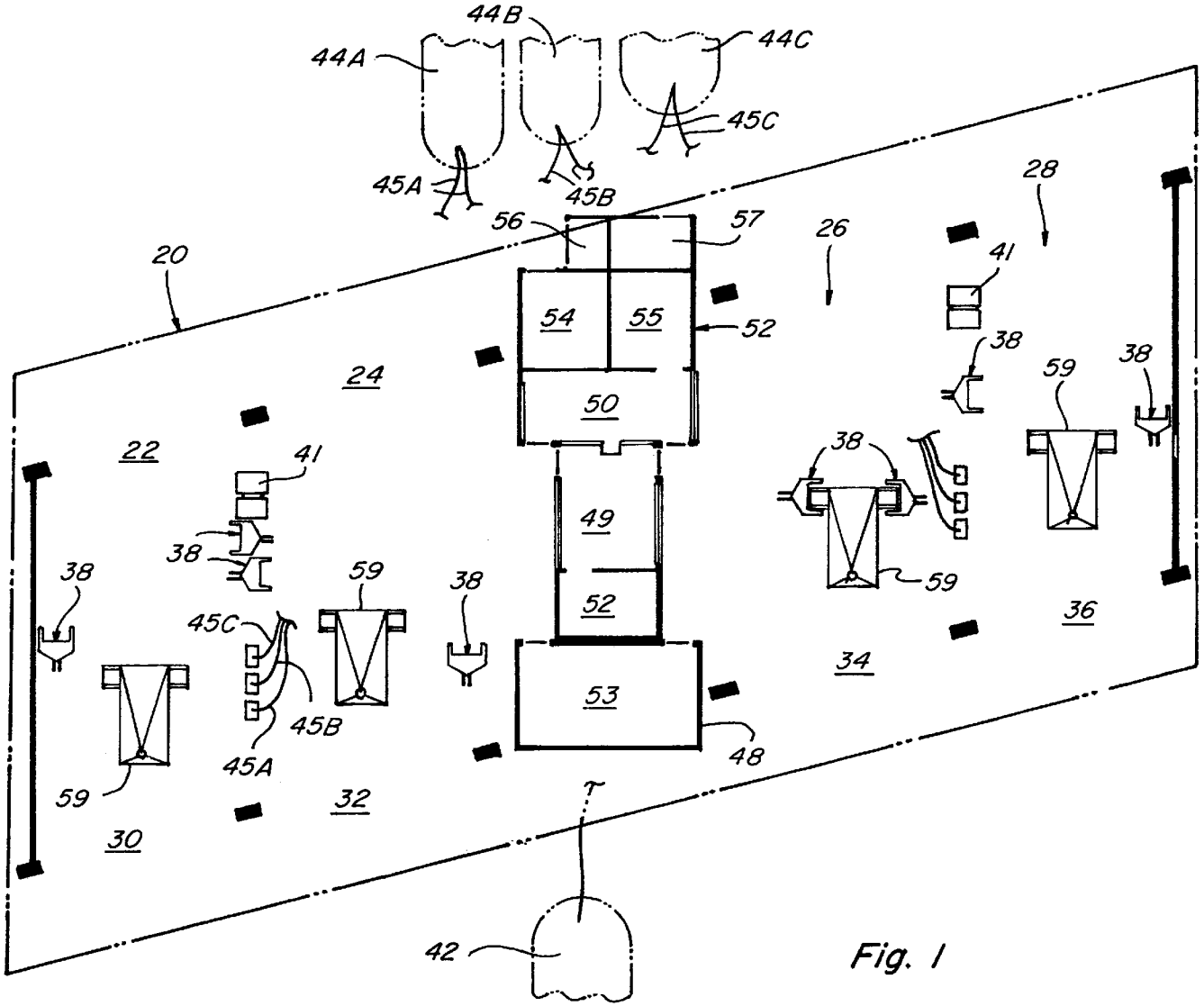
FIG. 1 is a floor plan of a representative building in to which vehicles can be driven for servicing and lubricating.
Figure 2:
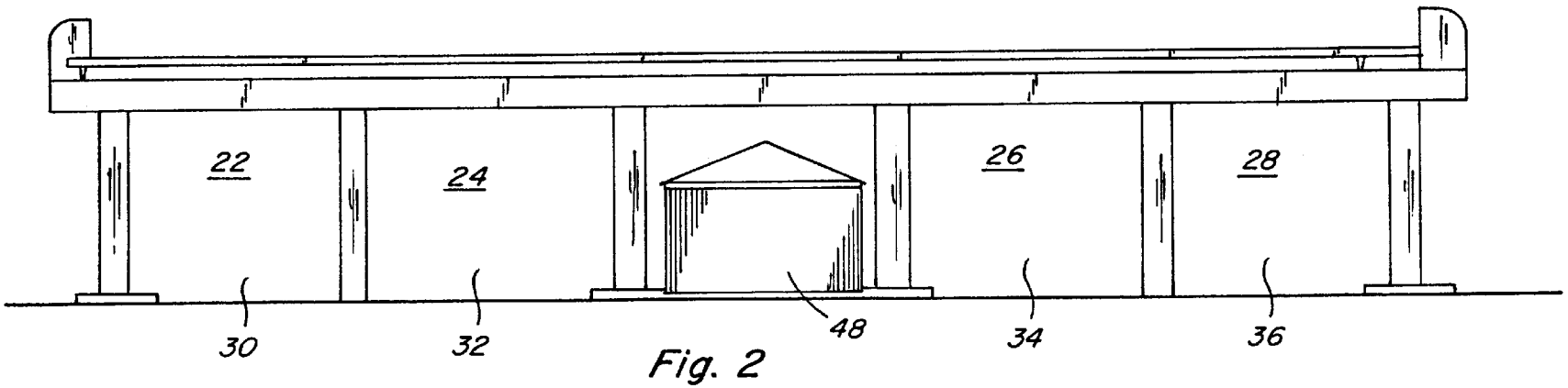
FIG. 2 is a front plan view of the building shown in FIG. 1.

FIG. 1 shows a representative floor plan of a service center 20 that is constructed according to the present invention and designed to provide a facility where truck drivers and the like can bring their trucks to be self-serviced on-site. The center 20 depicted in FIGS. 1 and 2 has a plurality of service spaces or bays 22, 24, 26, and 28, each of which has a respective entrance or doorway 30, 32, 34, or 36 that can be accessed to enable a vehicle to be driven into one of the service bays. Each bay is preferably constructed to occupy a single level, without any service pit or well or any necessity for the placement of fixed position hydraulic or other lifting mechanisms. Such construction facilitates the easy cleaning of the facility and permits the use of a bay by a multitude of vehicles, without size restrictions based upon dimensions of a service pit or the position and size of a fixed position lifting mechanism. While it is preferred for a facility to include a plurality of individually accessible bays, it should be understood that the service center could have but one service space or bay with an associated entrance or doorway rather than having a plurality of bays for service, or could have multiple bays accessed through a common entryway, The center may also offer convenience facilities for the driver and any passengers, including a location where the products and services that are used can be paid for, a waiting room, restroom facilities, a place to buy food or other items, an entertainment area, and locker and shower facilities, as may be required or desired.

Any of a variety of known techniques and apparatus can be employed to control access to a service space or bay. Typically, a human attendant may control or enable access to a service space or bay, although automated mechanisms and systems not requiring human intervention can also be readily employed. Such mechanisms and systems can include components and subsystems that will not operate to permit access until appropriate billing or credit information is provided, such as at or through a data information entry device, which device may include portions for obtaining information from a credit card, debit card, or smartcard, or the like, or for accepting coinage, tokens, bills, or documents. Many types of such systems presently exist or can be readily modified for such purposes. Such mechanisms and systems may, in some configurations, be incorporated into or form part of an activities oversight system for the facility, as will be further addressed hereinafter.

With an open doorway accessed, the driver can drive his vehicle into the building and park in a service area. Utilizing movable or mobile lifting devices or mechanisms 38 available at such service area, the driver can position the devices to engage the vehicle, generally at all or some of the wheels of the vehicle, so that all or part of the vehicle can be supported on the lifting devices as the driver operates them to raise all or portions of the vehicle to a desired elevation for purposes of servicing and for purposes of lubrication, as required. The lifting devices or mechanisms will preferably be of a type that can be operated to elevate the underside of a vehicle to a sufficient height to allow the driver to easily access the underside of the vehicle. The center may provide instructions that can be reviewed by the driver to familiarize himself with the thins that need to be done to position and operate the particular lifting mechanisms employed and to perform the other services that are needed, which instructions can be provided in various fashions, including posted information, hard copy documents, and audio and video presentations, as may be desired.

Figure 3:
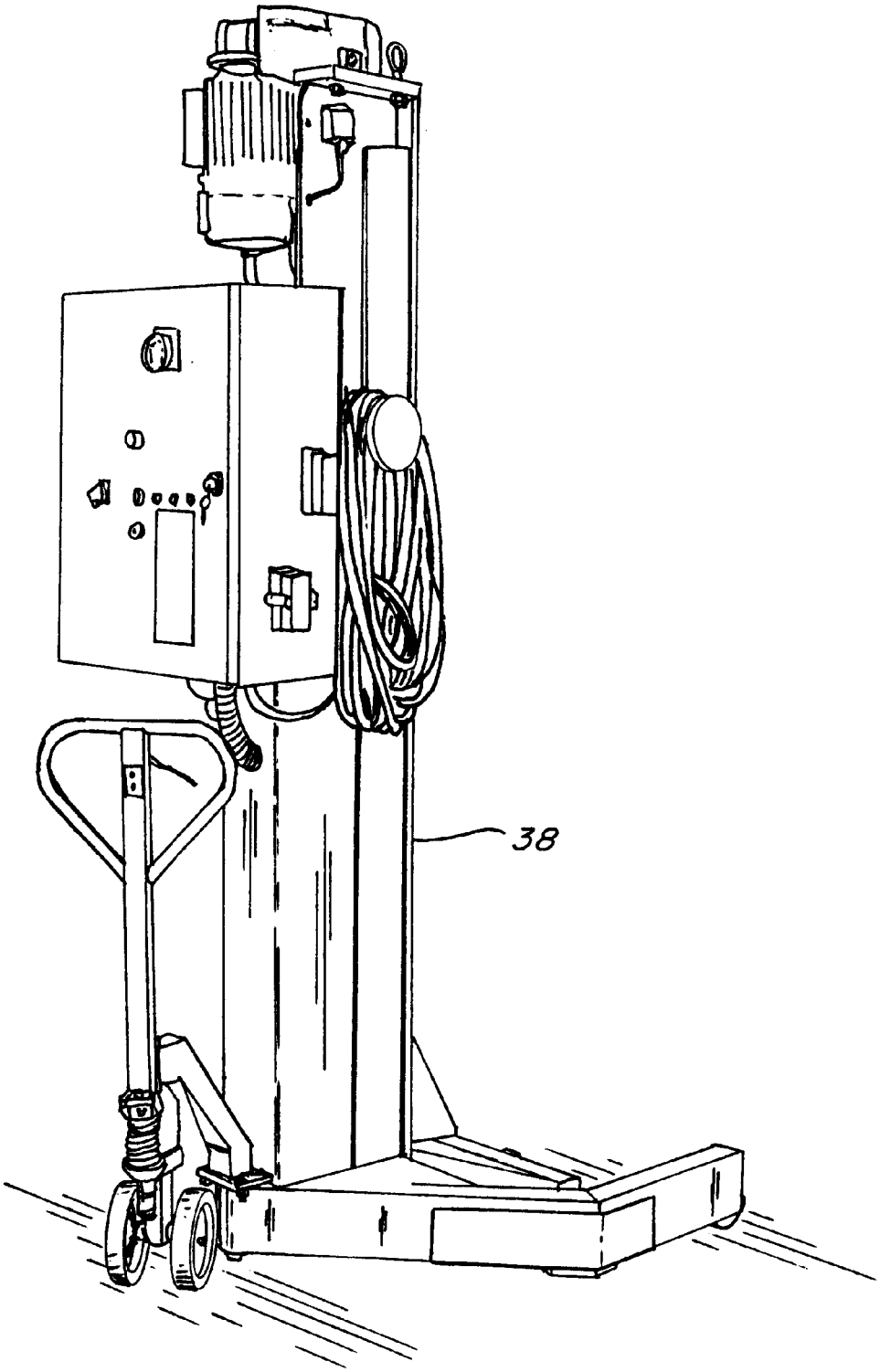
FIG. 3 is a drawing depicting a lifting mechanism of the type that may be utilized to elevate portions of vehicles to facilitate the servicing thereof.
Figure 4:
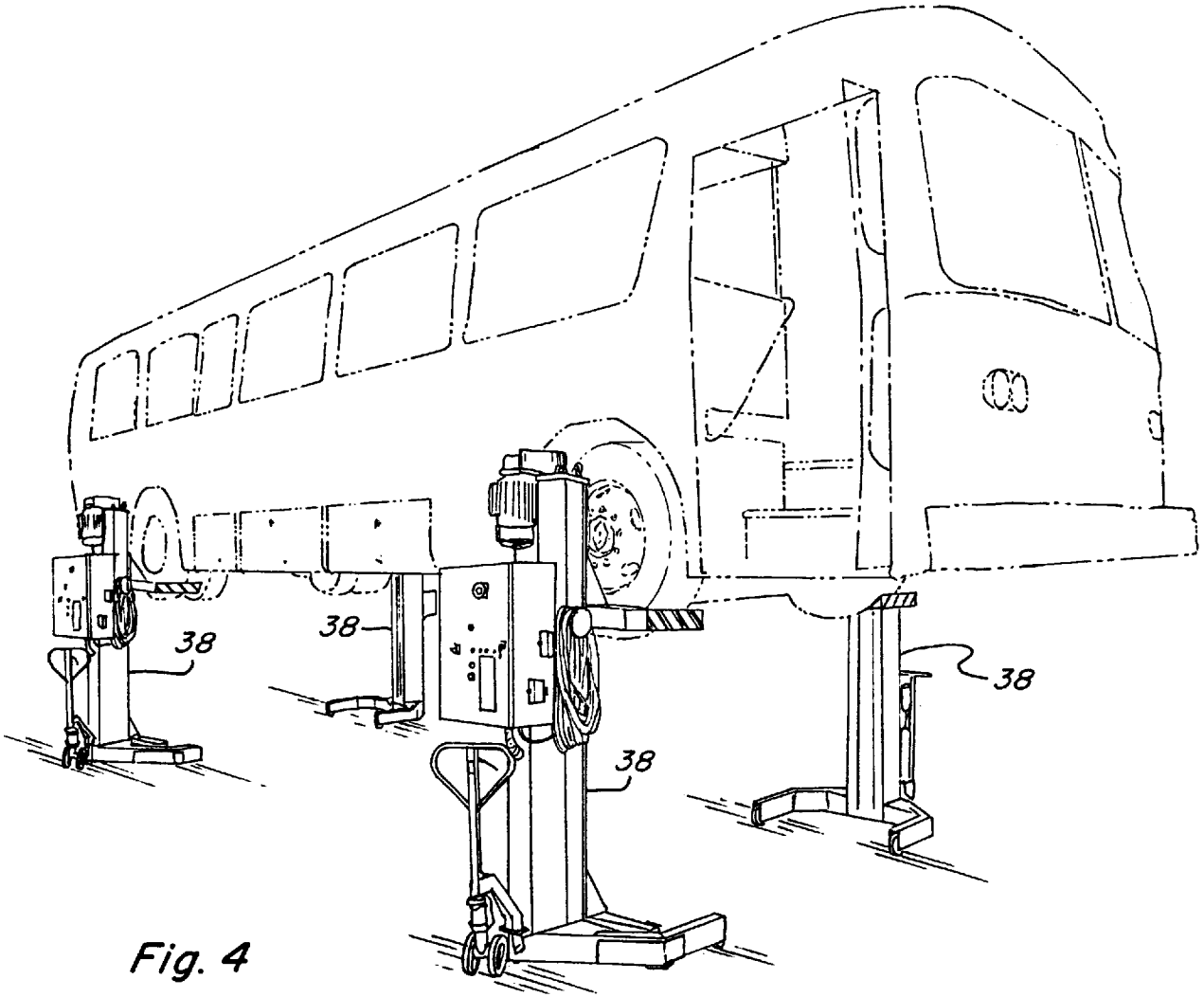
FIG. 4 is a drawing depicting the manner in which lifting mechanisms can be positioned and operated to elevate a large vehicle off of the ground to facilitate the servicing thereof.

While a variety of mobile lifting mechanisms could be readily utilized, it has been found that SEFAC Mobile Lifts, including Models 1200 M100 and 1600 M100, manufactured by SEFAC Lift & Equipment Corporation, such as depicted in FIG. 3, work well for the desired purpose. Such mobile lifts, especially when utilized in multiples, as depicted in FIG. 4, can safely be utilized by a single person to lift vehicles large and small to a height that is comfortable for the person servicing the vehicle. Vehicles up to 96,000 lbs. can be lifted by employing a set of six lifts. Preferably the particular lifting mechanisms employed, like the SEFAC Mobile Lifts, which are electromechanical and use a fail-safe, non-reversible, self-locking machine screw system, will employ safety locking systems or related components and devices to ensure safe operation and stable lifting and support of the vehicle for servicing.

While, as noted, the preferred SEFAC mobile lifts are electromechanical devices that utilize machine screw systems, other types of lifting devices could likewise be readily and conveniently utilized, including, but not necessarily limited to, various hydraulic, electric, and mechanical devices.

After the driver has positioned the lifting devices 38 to engage the vehicle, such as at the wheels of the vehicle, the lifting devices can then be operated to raise all or portions of the vehicle off of the floor to a desired elevation so that the operator or driver can have access to the underside of the vehicle to be able to service the vehicle and lubricate it, as required. The use of the mobile lift devices 38 makes it unnecessary for there to be a pit or below surface well where the driver needs to go to provide the servicing.

Once the various lifting devices 38 have been operated to lift the vehicle upwardly off the floor to a suitable elevation for servicing, the operator can move freely about under the vehicle to check the various vehicle components and can also attach drainage apparatus to the vehicle by which the then-present lubricant can be drained from the vehicle. Such drainage apparatus may typically include hoses or conduits for draining the oil, such as to waste oil containers 41 for collection into waste oil tank 42.

Once the waste oil has been drained and the drainage apparatus disengaged from the vehicle, lubricant fill apparatus can be utilized by the vehicle operator to replenish the vehicle lubricants. When using the present facility the truck driver is preferably able to access and obtain oil from selectable fresh oil containers 44A, 44B, or 44C, each of which hay be installed underground and exterior to the building, if so desired, and each of which contains a different lubricant having a different, particular characteristic. Typically, the oil containers are connected through one or more hose or conduit connections 45A, 45B, 45C to respective pumps and metering devices 46A, 46B, 45C and to dispensing hoses and their nozzles 47A, 47B, 47C to permit the operator to controllably provide a metered flow of fresh lubricant into his vehicle. It has been found that air driven dispensing pumps with flow metering devices operate well for Such purpose.

Such self-service operations can be readily effected by the operator and alleviate the necessity, with known home self-servicing techniques, for the operator to have to buy oil in cans and drums that then need to be disposed of at the driver's home or elsewhere. Other maintenance and repair operations can also be performed while the vehicle is raised.

When the various operations have been completed, the vehicle can be lowered to the floor and driven out of the center.

Although the servicing operation, as described above, addresses the operation of providing new lubricant as occurring while the vehicle is in an elevated position, and prior to any operation of the lifting mechanisms to lower the vehicle back to a resting state upon the floor of the facility, it should be clearly understood and appreciated that the operation of filling the vehicle with new lubricant need not necessarily be effected while the vehicle is in an elevated condition, especially in situations where, or with configurations in which, it might be difficult to access the lubricant fill portals while the vehicle is in a partially or fully elevated condition. Accordingly, after an oil draining operation has been completed, the lifting mechanism may be operated to lower the vehicle, either to a lower elevated condition or to a normal position resting, upon the floor of the facility, to facilitate access to the oil fill portals of the vehicle. The order of occurrence of the operations of filling the vehicle with new oil and operating the lifting mechanism to lower the vehicle to a normal condition resting on the floor of the facility should therefore be considered discretionary to the operator, depending generally upon all the attendant circumstances and configurations, and, for purposes of discussion herein and reference thereto, the order of such operations should generally be considered to be and treated as though they are interchangeable.

Referring again to FIG. 1, a centralized enclosure 48 is shown positioned within the center at a location convenient to the various bays and including a central access or waiting area 49. where candy, soda, and other products can be purchased, disposed between an attendant position or office 50 and restroom facilities 52. Additional rooms 53–57 may also be provided as equipment or storage areas, including a storage area such as room 55 for tools or products, the access to or sale of which are controlled such as by a human attendant.

Also shown located in the bay areas of the center are floor drain panels 59 with wheel stop locators, which drain panels may be conveniently employed to facilitate the drainage of waste oil from a vehicle and into waste oil tank 42.

Tool storage areas may be conveniently located within or about the individual bays or in a centralized location, such as room 55, depending upon the tools to be stored or utilized. In some instances or for some tools, it may be desirable to restrict or control access to the tool, or to require or charge an additional fee for use thereof. Typically, access to or permitted time of use of a tool may be controlled by the human attendant or an automated attendant system.

Figure 5:
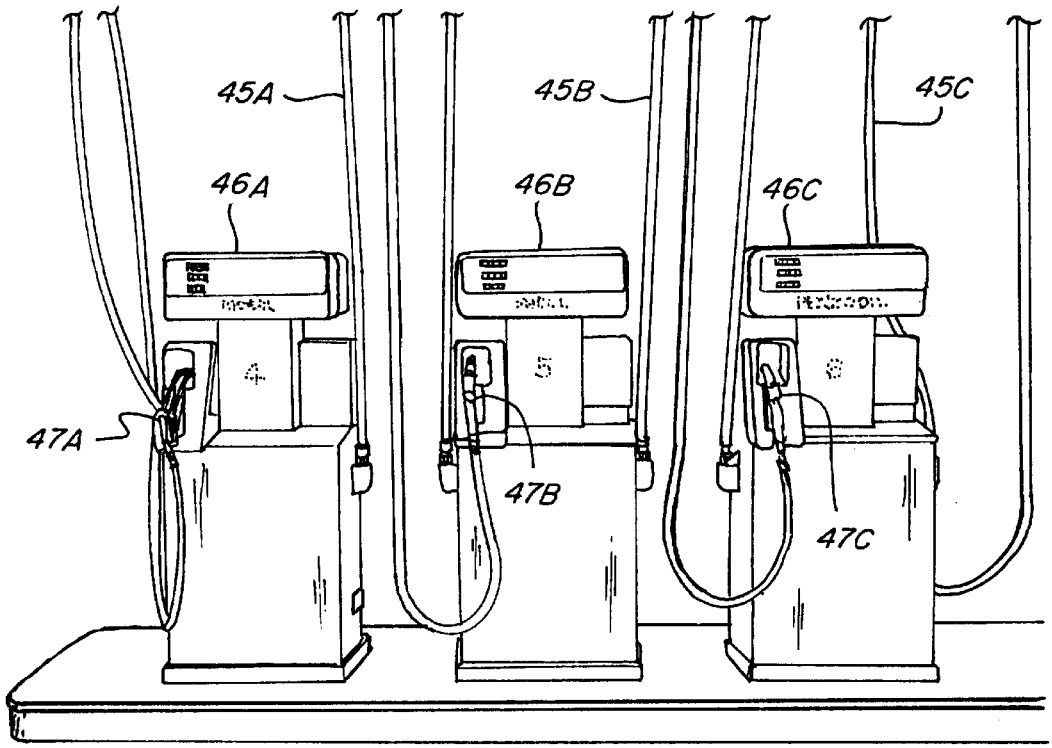
FIG. 5 is a drawing depicting oil pump devices such as may be employed to dispense fresh lubricant during the process of vehicle servicing.
Figure 6:
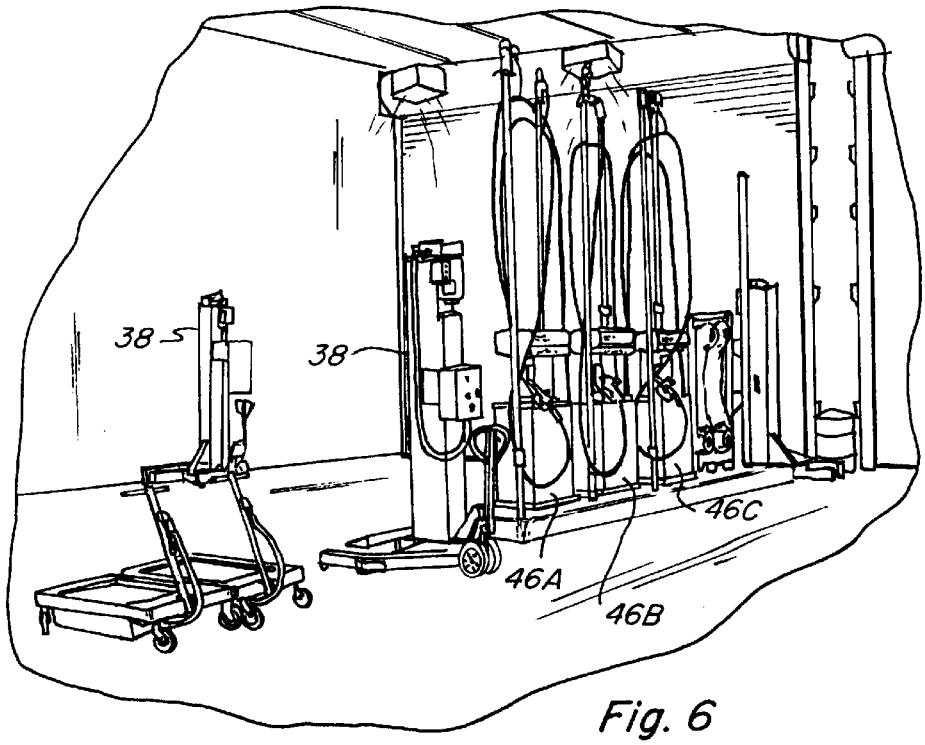
FIG. 6 is a drawing depicting an arrangement of equipment for use during the servicing of a vehicle.

FIGS. 5 and 6 depict typical or preferred manners of positioning certain of the servicing devices or mechanism, such as the lubricant dispensing devices and several lifting devices, within the building for easy access and use when a vehicle is presented for servicing.

Figure 7:
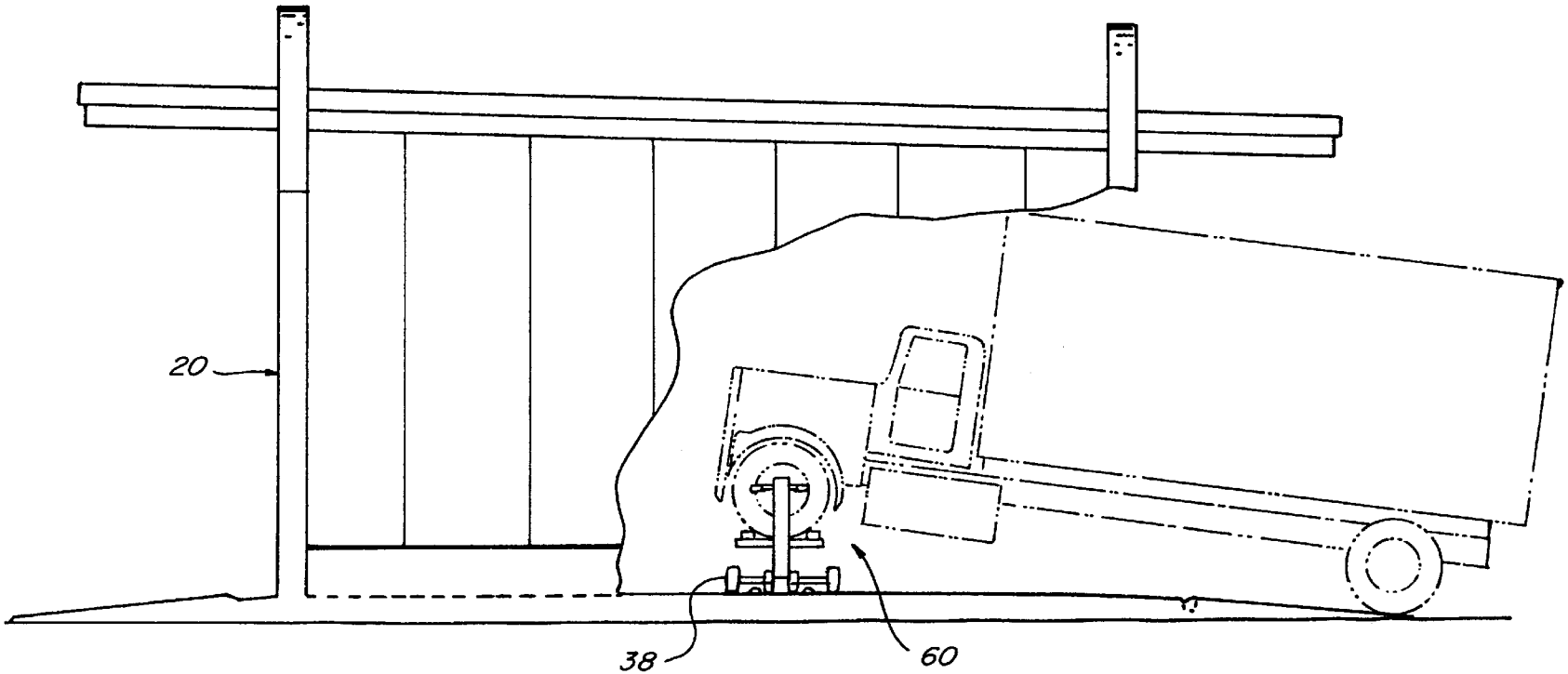
FIG. 7 is a side view of a different vehicle whose front portion has been elevated to permit the servicing thereof.

FIG. 7 is an end view of the subject center showing in dotted outline the front end of a truck 60 extending into the center 20 with the truck's front resting in raised condition on lifting devices 38 so that, unlike FIG. 4, the front portion, but not the rear portion, of the vehicle has been elevated to permit servicing. It should be clearly understood and appreciated that the entirety of a vehicle need not necessarily be elevated to permit servicing and that, in appropriate circumstances, it may be necessary to only use two or even only one lifting mechanism to effect the necessary elevation of a portion of a vehicle to facilitate the servicing thereof. It should also be understood and appreciated that the use of additional equipment, such as wheel blocks, may be desirable in many instances from a safety standpoint and so as to prevent undesirable movement of a vehicle as a portion thereof is being elevated or lowered.

Once the vehicle has been serviced as required, the operator of the vehicle can go to the attendant office 48 where the goods and services provided can be paid for or charged, as desired. Typically, the attendant system for the center is based or controlled from the attendant office or area and will include an activities oversight system for monitoring various activities or operations, including, by way of example and not limitation, the metered dispensing of fresh lubricant, bay access time, and tool usage time. The activities oversight system may include or make use of various known systems, components, and mechanisms for the automated performance of some or a number of control and accounting features of the facility's operation, or may be specifically designed in accordance with the present invention for the particular characteristics of an individual facility.

Typically, if a human attendant it utilized, such attendant will interface with the activities oversight system to obtain from such system a calculation of charges for the customer's servicing activities, including by way of example and not limitation, determinations of the amount, type, and unit cost of lubricant drawn by the customer, the time duration for use of the service bay, the cost for use of certain tools, perhaps on a time duration basis, the costs for any consumables utilized by the customer, e.g., a new oil filter, and related information and costs. Such costs can be determined automatically by the system and the human attendant can coordinate and accept payment from the customer, which payment may be accommodated by various known devices and techniques.

Alternatively, the attendant system may be designed to obviate the need for a human attendant and may provide for the automated determination of charges and collection of payment from the customer. With an automated attendant, the center can operate independently of any person being present, except for the customer, i.e., the person driving the vehicle being serviced. Such operation provides the motoring public with an efficient and relatively inexpensive way of servicing vehicles, and especially large over-the-road vehicles, and at times that are convenient to the driver.

The present center may also include door or gate opening devices which can be controlled by the vehicle driver so that when he reaches one of these centers, he can himself open a door or other access limiting device to obtain entry or access to a service area. The opening of the door can also energize means for measuring the time from when the door is opened until the vehicle is removed at a later time. This also provides a way by which the owner or operator of the center can determine the time the vehicle was in the service center, and this can be used as a way for determining the amount to charge. The subject center can also include sets of tools which can be made available to the driver once he has obtained entry and the tools can be used to make repairs or do other work on the vehicle.

It Is also envisioned to have a number of similar service centers located about the country. In Such event, each driver who is authorized to use the service centers could be provided with an appropriate opening device, card, or medallion, which may be encoded or individualized in various manners. A map or chart of the locations of the various centers could also be produced and distributed to the people who use the various centers so that they would know where the service centers are located as they travel about the country. Especially in such event, since the centers would not need to have on-site personnel located there at all times, the centers could still be made available to the drivers or others at the locations of the centers as their individual needs arise.

It is also contemplated that a central service center could be established having telephone communication with the various centers located around the country, which adds another possibility of service to the customer by enabling the customers to contact the centers by phone to find out if they are available, where they are located, and how to find them.

It can thus be seen that the subject service centers, and the process of use thereof, provide a wide range of service possibilities in accordance with all of which the cost of the services can be determined by the length of time a member or customer has his vehicle in the service center and by the kinds of equipment and products that he uses.

As has been explained, the service center and its use are designed such that the service activities can be performed by the operator of the vehicle at any convenient time and without requiring outside help, which makes for a convenient and relatively inexpensive operation and one which reduces substantially the cost of operating trucks and other vehicles on the highways. If the driver nevertheless determines that outside assistance is needed for some reason, help may generally be obtained by contacting the person who handles the accounting or other procedures at the location. As a general rule, though, it is anticipated that the driver of the vehicle will be able to handle the matters including the servicing and lubricating of his vehicle without help. This self-service capability will substantially reduce the cost of vehicle servicing and make this process a convenient way of servicing vehicles without the necessity for having to make arrangements ahead of time and without having to have assistance in the servicing and lubricating of his vehicle.

From the foregoing, it should be appreciated that the subject centers may generally be constructed at lower costs then previous serve facilities because they require neither the construction of wells or pits for access by the people working on the vehicle to access the underside of a vehicle nor the provision of built in hydraulic or electric lifting devices. The design of such center facilitates the easy use thereof by vehicle operators on a self-service basis, and the operation, maintenance, and repair thereof by facility owners and operators.

Thus, there has been shown and described a novel self-service maintenance and lube center system and the operation and use thereof, which system and method fulfill the various objects and advantages sough therefor. It will be apparent to those skilled in the art, however, that many changes, variations, modifications, and other use and applications of the subject system and method are possible, and all such changes, modifications, variations, and other uses and applications which do not depart from the spirit and scope of the invention are deemed to be covered by the invention, which is limited only by the claims which follows.

What is claimed is:

1. A service center to accommodate over-the-road vehicles and the self-serve lubrication thereof without the necessity of a service pit, comprising a building with a service area sized to accommodate over-the-road vehicles and accessible through an entranceway through which a vehicle to be serviced and lubricated can be driven, said building including at least one mobile lifting mechanism positionable by a vehicle operator to engage and lift, and to subsequently lower, a portion of the vehicle to be serviced, all under the control of such operator, lubricant drainage apparatus engageable with the vehicle by the operator thereof and operable by such operator to drain lubricant from the vehicle, lubricant fill apparatus engageable with the vehicle and operable by the vehicle operator for feeding lubricant to the vehicle as required, including metering apparatus for determining the amount of lubricant added to the vehicle, and an attendant system for controlling use of said service center and its equipment, including calculation of amounts due by the vehicle operator.

2. The service center of claim 1 wherein said service area includes a generally uniform floor area upon which said lifting mechanism can be moved and positioned.

3. The service center of claim 1 wherein said attendant system includes an access control mechanism operable to permit entry and removal of a vehicle from the building and an accounting system for determining the amount due for the self-service lubrication operation.

4. The service center of claim 3 wherein said attendant system is an automated system.

5. The service center of claim 3 wherein said access control mechanism and said accounting system are operable under control of a human attendant.

6. The service center of claim 1 wherein said center includes a reservoir having a supply of lubricant and said lubricant fill apparatus includes a pumping mechanism to feed lubricant from the supply to the vehicle being serviced.

7. The service center of claim 6 wherein said pumping mechanism is air driven and includes an associated nozzle engageable with the vehicle and a trigger assembly actuatable to effect the delivery of lubricant from said supply through said nozzle and to the vehicle.

8. The service center of claim 1 wherein said center includes a plurality of reservoirs for holding supplies of different lubricants and said lubricant fill apparatus includes pumping apparatus operable to selectively deliver lubricant from a given reservoir to the vehicle.

9. The service center of claim 1 wherein a plurality of lifting devices are interconnectable with one another and operable when positioned to engage wheels of a vehicle to operate in unison to generally uniformly raise or lower those wheels and the associated portions of the vehicle.

10. A process for the self-service and lubrication of over-the-road vehicles without the necessity of a service pit, comprising, providing a building structure having a floor and a entryway through which a vehicle to be serviced and lubricated can be driven into and out of the structure, at least one mobile operator actuatable lifting device engageable with the vehicle to be serviced and operable when so engaged to elevate at least a portion of the vehicle off the floor, lubricant drainage apparatus engageable with the vehicle and operable to drain lubricant therefrom, lubricant filling apparatus engageable with the vehicle and operable to provide lubricant to the vehicle, and an attendant system for controlling access to and use of the structure and equipment thereof and for permitting a vehicle operator to effect the self-service lubrication of the vehicle to be serviced according to a process including driving the vehicle to be serviced into a service position in the structure, positioning at least one mobile operator actuatable and cotrollable lifting device to engage the vehicle and operating the lifting device to elevate a portion thereof above the floor to provide ready access to the underside thereof, operating said lubricant drainage apparatus to effect engagement thereof with the vehicle and to drain lubricant from the vehicle, thereafter interchangeably operating said lubricant fill apparatus to effect engagement thereof with the vehicle and to add lubricant to the vehicle and operating the lifting device to lower the vehicle, whereby upon completion of the servicing and lubricating operations the vehicles is resting upon the floor of the structure, said process further including effecting operation of the attendant system to determine the amount of money due for the use of the structure and equipment and for the lubricant added.

11. The process of claim 10, wherein the lubricant fill apparatus that is provided includes al flow meter for metering the amount of lubricant added and the attendant system includes an accounting system that determines an amount due for the amount of lubricant added.

12. A method for controlling and effecting the self-service changing of oil in an over-the-road vehicle by an operator user thereof without the necessity of a service pit, comprising:

providing a facility having at least one bay sized to accommodate over-the-road vehicles, a user controllable and operable mobile vehicle lifting mechanism, said mechanism being transportable by the user and positionable thereby to engage an over-the-road vehicle positioned in a bay and operable by the user when so positioned to raise a portion of such vehicle to permit ready access by the user to the oil drainage portal of such vehicle, at least one waste oil holding tank, an oil drainage conduit for receiving oil as it is drained from such vehicle through the oil drainage portal thereof and for routing such drained oil to said waste oil holding tank, at least one fresh oil holding tank, at least one oil metering pump connectable to said fresh oil holding tank to draw oil therefrom and an associated hose and nozzle assembly for controllably metering the flow of oil therethrough and dispensing fresh oil into the oil fill portal of the over-the-road vehicle, a set of tools including user operable tools for effecting the changing of oil in such vehicle, a tool storage area for holding said set of tools and being accessible to a user upon access being provided thereto, an attendant area including an activities oversight system for monitoring at least the metered dispensing of fresh oil by said metering pump and for totaling the charges to be assessed to a user for the self-servicing of such vehicle at said facility, providing an attendant system to control access to a bay and the self-servicing by the user of such vehicle at said facility, said attendant system being responsive to a request by a user to control access to the facility and a bay therein, including to said tool storage area, to said set of tools held therein, and to said oil metering pump, the user, when granted access, being authorized and enabled to utilize said facility and a given bay therein for oil change servicing of the vehicle, including the actions of drivably positioning the over-the-road vehicle in a normal lowered at rest state within said given bay, positioning said user controllable and operable mobile vehicle lifting mechanism to engage the over-the-road vehicle and operating said lifting mechanism when so positioned to raise a portion of the vehicle to permit ready access by the user to the oil drainage portal of such vehicle, positioning said oil drainage conduit at an access position with the vehicle to receive oil to be drained from said oil drainage portal of the vehicle, utilizing said set of tools to effect the drainage of oil through said oil drainage portal of the vehicle and through said oil drainage conduit to said waste oil holding tank, performing, in interchangeable order, the actions of positioning said nozzle associated with said oil metering pump at an access position with the vehicle to dispense oil therethrough into the oil fill portal of said vehicle and effecting the operation of said oil metering pump when said nozzle is so positioned to provide a metered amount of oil into the oil fill portal, operating said lifting mechanism, following removal of said oil drainage conduit from its access position with the vehicle, to return the vehicle to its lowered at rest state within said given bay, said attendant system assessing the charges for such self-servicing of the vehicle by the user within said given bay, including the charges as determined by said activities oversight system, and controlling the authorized removal of the vehicle from said given bay.

13. The method of claim 12 wherein said facility is provided to include a plurality of bays sized to accommodate over-the-road vehicles.

14. The method of claim 12 wherein said facility is provided to include a plurality of fresh oil holding tanks, and a plurality of oil metering pumps connectable to respective fresh oil holding tanks to draw oil therefrom and an associated hose and nozzle attachable to each said oil metering pump for controllably metering the flow of oil therethrough and dispensing fresh oil into the oil fill portal of the over-the-road vehicle, and wherein said activities oversight system is operable to monitor the metered dispensing of fresh oil by each of said metering pumps.

15. The method of claim 12 wherein said facility is provided to further include a stock of oil filters accessible to an attendant and said set of tools includes tools operable by the user to effect removal and replacement of an oil filter of the vehicle, said attendant providing the user with an oil filter from said oil filter stock and said user utilizing said set of tools during the vehicle servicing to effect the removal of the oil filter of the vehicle and the replacement thereof with the oil filter provided by said attendant from said oil filter stock.

16. The method of claim 12 wherein said attendant is an automated attendant.

17. The method of claim 12 wherein said facility is provided to include a bay access control mechanism operable under control of said attendant to permit entry and removal of the vehicle from the given bay.

18. The method of claim 17 wherein the bay access control mechanism includes at least one openable and closable door associated with each bay.

19. The method of claim 17 wherein said attendant system is an automated attendant system.

20. The method of claim 19 wherein said automated attendant system includes a device for reviewing and determining the acceptability of a payment item presented thereto, said automated attendant system controlling the opening and closing of a bay door, and the dispensing of oil from an oil metering pump, consistent with acceptability of the payment item.

21. The method of claim 12 wherein the bay includes a pitless floor devoid of fixed position lifting assemblies.

* * * * *

UNITED STATES PATENT AND TRADEMARK OFFICE

CERTIFICATE OF CORRECTION

PATENT NO. : 6,651,778 B1 
DATED : November 25, 2003
INVENTOR(S) : Kevin J. Manning and Thomas P. Manning, Jr.

It is certified that error appears in the above-identified patent and that said Letters Patent is hereby corrected as shown below:

Title page,
Item [57], ABSTRACT,
Line 5, "lifts" should be -- lift, --.

Column 3,
Line 55, "entryway," should be -- entryway. --.

Column 4,
Line 25, "thins" should be -- things --.

Column 5,
Line 59, "49." should be -- 49, --.

Column 7
Line 20, "In Such event," should be -- In such event, --.

Signed and Sealed this

Twenty-fourth Day of February, 2004

JON W. DUDAS
*Acting Director of the United States Patent and Trademark Office*